US010765168B2

(12) United States Patent
Johnson et al.

(10) Patent No.: US 10,765,168 B2
(45) Date of Patent: Sep. 8, 2020

(54) SHOE, IN PARTICULAR A SPORTS SHOE

(71) Applicant: PUMA SE, Herzogenaurach (DE)

(72) Inventors: Charles Johnson, Nuremberg (DE); Thomas Krüger, Aurachtal (DE); Reinhold Sussmann, Scheinfeld (DE)

(73) Assignee: PUMA SE, Herzogenaurach (DE)

( * ) Notice: Subject to any disclaimer, the term of this patent is extended or adjusted under 35 U.S.C. 154(b) by 0 days.

(21) Appl. No.: 15/769,929

(22) PCT Filed: Oct. 23, 2015

(86) PCT No.: PCT/EP2015/002106
§ 371 (c)(1),
(2) Date: Apr. 20, 2018

(87) PCT Pub. No.: WO2017/067566
PCT Pub. Date: Apr. 27, 2017

(65) Prior Publication Data

US 2019/0053569 A1 Feb. 21, 2019

(51) Int. Cl.
*A43B 7/14* (2006.01)
*A43B 23/02* (2006.01)
(Continued)

(52) U.S. Cl.
CPC ..... *A43B 7/14* (2013.01); *A43B 5/00* (2013.01); *A43B 9/00* (2013.01); *A43B 9/12* (2013.01);
(Continued)

(58) Field of Classification Search
CPC ..... A43B 23/0235; A43B 3/24; A43B 3/242; A43B 9/00; A43B 5/025; A43B 5/05;
(Continued)

(56) References Cited

U.S. PATENT DOCUMENTS 3,500,561 A * 3/1970 Epstein ..... A43B 3/30 36/112
4,856,209 A * 8/1989 Kenyon ..... A43B 7/20 36/114

(Continued)

FOREIGN PATENT DOCUMENTS

FR 1228239 A1 8/1960
FR 2835405 A1 8/2003

(Continued)

OTHER PUBLICATIONS

"Circumferential", Dictionary.com. Web. retreived Apr. 4, 2019. https://www.dictionary.com/browse/circumferential.*

(Continued)

*Primary Examiner* — Jillian K Pierorazio
(74) *Attorney, Agent, or Firm* — Lucas & Mercanti, LLP; Klaus P. Stoffel

(57) ABSTRACT

A shoe, comprising a sole and a shoe upper, wherein the sole comprises a sole part which has a base region from which at least one support part extends upwards during the intended use of the shoe, wherein the shoe upper comprises a sock-like section connected to the sole for receiving the foot of the wearer. To obtain improved contact of the shoe with the foot of the wearer, the at least one support part covers the sock-like section on the shoe outer side, wherein no firm connection exists between the support part and the sock-like section over at least a section of the support part and that both the at least one support part and the sock-like section are surrounded by a tensioning element which tensions at least some sections of both the support part and the sock-like section against the foot of the wearer of the shoe.

7 Claims, 5 Drawing Sheets

(51) Int. Cl.

| | |
|---|---|
| ***A43B 9/00*** | (2006.01) |
| ***A43B 13/14*** | (2006.01) |
| ***A43C 1/00*** | (2006.01) |
| ***A43B 19/00*** | (2006.01) |
| ***A43B 5/00*** | (2006.01) |
| ***A43B 9/12*** | (2006.01) |

(52) U.S. Cl.
CPC ..... *A43B 13/141* (2013.01); *A43B 19/00* (2013.01); *A43B 23/0235* (2013.01); *A43B 23/0245* (2013.01); *A43B 23/0255* (2013.01); *A43C 1/00* (2013.01)

(58) Field of Classification Search
CPC .. A43B 5/005; A43B 9/10; A43B 1/10; A43B 3/244; A43C 1/00
USPC ..... 36/114, 102
See application file for complete search history.

(56) References Cited

U.S. PATENT DOCUMENTS 5,339,544 A * 8/1994 Caberlotto ..... A43B 5/02 36/102
6,000,148 A * 12/1999 Cretinon ..... A43B 5/00 36/69
6,877,257 B2 * 4/2005 Delgorgue ..... A43B 5/0411 36/117.1
7,010,872 B2 * 3/2006 Pawlus ..... A43B 3/0047 36/100
7,444,768 B2 * 11/2008 Friton ..... A43B 23/26 36/50.1
7,624,517 B2 * 12/2009 Smith ..... A43B 7/14 36/50.1
7,647,709 B2 * 1/2010 Reilly ..... A43B 7/142 36/107
7,793,435 B1 * 9/2010 Ruth ..... A43C 11/00 36/50.1
8,074,379 B2 * 12/2011 Robinson, Jr. ..... A43C 1/06 36/108
8,230,618 B2 * 7/2012 Bruce ..... A43B 3/0078 36/114
8,479,415 B2 * 7/2013 Berger ..... A43B 3/24 36/100
2003/0159312 A1 * 8/2003 Farys ..... A43B 5/08 36/51
2004/0128863 A1 * 7/2004 Hong ..... A43B 3/24 36/100
2005/0138846 A1 * 6/2005 O'Connor ..... A43B 5/007 36/72 B
2007/0180730 A1 * 8/2007 Greene ..... A43B 9/00 36/3 A
2009/0071039 A1 * 3/2009 Sussmann ..... A43B 3/0047 36/105
2009/0183392 A1 * 7/2009 Shane ..... A43B 1/0027 36/97
2009/0241374 A1 * 10/2009 Sato ..... A43B 1/04 36/45
2011/0041362 A1 * 2/2011 Nishiwaki ..... A43B 5/10 36/114
2011/0126431 A1 * 6/2011 Mazzarolo ..... A43B 5/145 36/3 A
2011/0138652 A1 * 6/2011 Lucas ..... A43B 13/183 36/28
2011/0197475 A1 * 8/2011 Weidl ..... A43B 1/0009 36/107
2012/0066931 A1 * 3/2012 Dojan ..... A43B 23/0235 36/83
2012/0216422 A1 8/2012 Ikezawa
2012/0317841 A1 * 12/2012 Taylor ..... A43B 3/0084 36/103
2013/0312284 A1 * 11/2013 Berend ..... A43B 1/0027 36/84
2014/0033573 A1 * 2/2014 Wills ..... A43B 3/246 36/103
2014/0317962 A1 * 10/2014 Smith ..... A43B 23/0205 36/102
2015/0013187 A1 * 1/2015 Taniguchi ..... A43B 1/04 36/84
2015/0047227 A1 * 2/2015 Fallon ..... A43B 23/026 36/88
2015/0089839 A1 4/2015 James
2015/0342261 A1 12/2015 Boucher et al.

FOREIGN PATENT DOCUMENTS

| | | | |
|---|---|---|---|
| FR | 2999882 | A1 | 6/2014 |
| JP | 2617812 | B2 | 6/1997 |
| WO | 2012012332 | A2 | 1/2012 |
| WO | 2011058614 | A1 | 3/2013 |

OTHER PUBLICATIONS

"Region", Collins Web. retreived Aug. 13, 2019. https://www.collinsdictionary.com/us/dictionary/english/region.*

* cited by examiner

SHOE, IN PARTICULAR A SPORTS SHOE

CROSS-REFERENCE TO RELATED APPLICATION

The present application is a 371 of International application PCT/EP2015/002106, filed Oct. 23, 2015, the priority of this application is hereby claimed and this application is incorporated herein by reference.

BACKGROUND OF THE INVENTION

The invention relates to a shoe, in particular to a sports shoe, comprising a sole and a shoe upper, wherein the sole comprises a sole part which has a base region from which at least one support part extends upwards during the intended use of the shoe, wherein the shoe upper comprises a sock-like section connected to the sole for receiving the foot of the wearer, wherein the at least one support part covers the sock-like section on the shoe outer side, wherein no firm connection exists between the support part and the sock-like section over at least a section of the support part and wherein both the at least one support part and the sock-like section are surrounded by a tensioning element which tensions at least some sections of both the support part and the sock-like section against the foot of the wearer of the shoe.

Sports shoes of this kind are well known. Beside a base plate structure the sole part often comprises sections which extend upwards which should give the foot of the wearer a proper hold.

Furthermore, it is known to employ a sock-like section in the region of the shoe upper which widely surrounds the foot of the wearer during intended use of the shoe.

Thereby, it is a continuous concern to design the shoe in such a manner that a best contact is given at the foot of the wearer. Thereby, a uniform tension is aimed for after the lacing of the shoe at the foot of the wearer.

A shoe of the above mentioned kind is known from WO 2012/012332 A2. Similar and other solutions are shown in FR 2 999 882 A1, FR 1 228 239 A, US 2015/0089839 A1, FR 2 835 405 A1 and US 2007/180730 A1.

SUMMARY OF THE INVENTION

It is an object of the invention to further develop a shoe of the generic kind that an improved contact at the foot of the wearer can be obtained when the shoe is laced at the foot of the wearer.

The solution of this object by the invention is characterized in that the tensioning element is designed as net-like structure which comprises a plurality of apertures, wherein a lace is threaded only into the apertures of the tensioning element to tension the tensioning element at the foot of the wearer of the shoe, wherein a support part is arranged in the rear side region and/or in the heel region of the shoe, wherein the support part extends along a height of at least 40% of the total height of the shoe.

The tensioning element can thereby be connected with the sole in the bottom region of the shoe. It can run circumferentially around the bottom side of the shoe. Thereby, a preferred embodiment provides that the tensioning element is fixed between a section of the sole and an outer sole which forms the bottom end of the shoe. The fixation between the sole part, the tensioning element and the outer sole can thereby take place by glueing.

An insole can be arranged in the inner of the sock-like section.

The support part extends preferably of at least 50% of the total height of the shoe.

Here, it can further be provided that a single support part is arranged in the heel region of the shoe, which comprises an insection in a central region. Hereby, it becomes possible in a specifically beneficial manner that after lacing the shoe contacts optimal the foot of the wearer also in the heel region.

Furthermore, each one support part can be arranged in the front or central region of the shoe.

The tensioning element can thereby—as the case may be apart from a location in the heel region—be connected with the sole only in the bottom region of the sole and can run apart from that without connection around the region of the shoe upper.

The net-like designed tensioning element can comprise a circumferential reinforcement rim in the region of the foot entry; this is formed preferably by a flat plastic band.

Thus, in any case an essential feature of the present concept is at least according to a preferred embodiment of the invention that the intermediate sole (called sole part in the above explanation) is provided along certain regions—especially in the heel region and in the side region—without connection to a sock-like inner shoe, wherein the shoe is surrounded at the outer side by a net-like structure. Only by the lacing of the net-like structure the intermediate sole is pulled against the sock-like inner shoe. Hereby, an improved fit of the shoe is possible.

Thereby, the net-like structure can extend down to the sole region; it can also extend completely around the bottom side of the shoe.

So, at the proposed concept a "sock" is given in the inner region of the shoe and the shoe upper respectively which is not connected at least partially with the intermediate sole; this applies at least for the side region, in the bottom region a connection can be provided.

Only the "net" tensions then by means of a lace the intermediate sole and the "sock" at the foot.

Thereby it results beneficially that after the lacing of the shoe the same contacts optimal the foot of the wearer and a very constant distribution of pressure is obtained onto the foot of the wearer.

Furthermore, it is beneficial that this can be obtained by relative easy producible measures which can be realized in a cost-efficient manner.

In the drawing embodiments of the invention are shown.

DETAILED DESCRIPTION OF THE INVENTION

Figure 1:
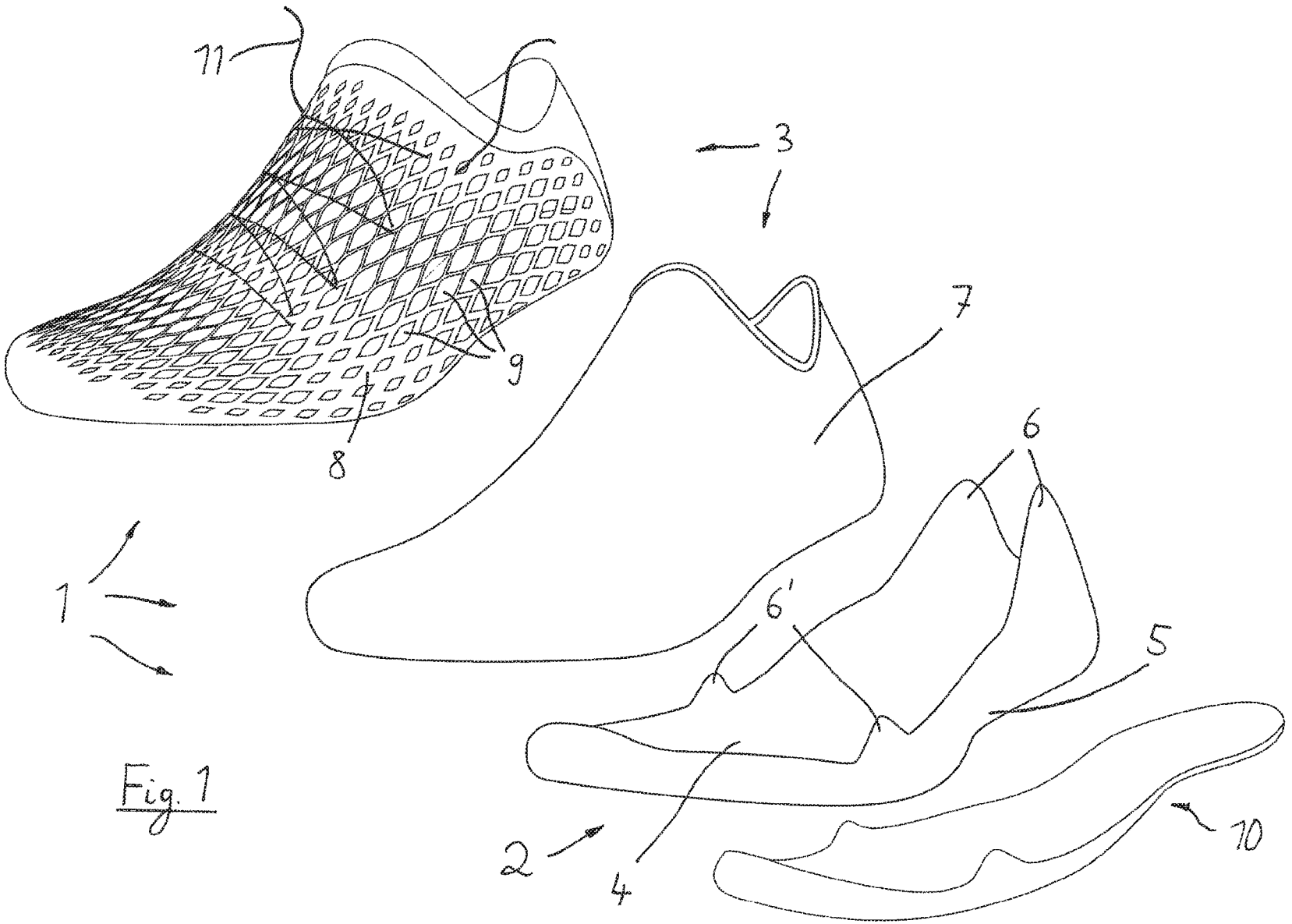
FIG. 1 shows an explosion view of a shoe according to the invention which is designed as sports shoe.

In FIG. 1 an embodiment of the shoe according to the invention is shown in an explosion view. The shoe 1 comprises a sole 2 and a shoe upper 3 which is connected with the sole 2. The sole consist here of a sole part 4 below which an outer sole 10 is arranged. The sole part 4 in turn has a base region 5 which corresponds to the shape of the foot contact area and has support parts 6 and 6' which extend vertically upwards.

The shoe upper 3 consists substantially of a sock-like section 7 which is provided for the reception of the foot of the wearer of the shoe and a tensioning element 8 in the form of a net-like structure.

The tensioning element 8 is provided due to its design as a net with a plurality of apertures 9 through which a lace 11 can be threaded to lace the shoe 1 at the foot of the wearer.

The tensioning element 8 is thereby provided to envelop the sock-like section 7 not only at its outer side but also to envelop the support parts 6, 6' at its outer side and to pull them against the foot at the lacing of the shoe at the foot of the wearer.

Thereby it is essential that the support parts 6, 6' cover the sock-like section 7 at the outer side of the shoe. Thereby, no firm connection is given between the support part 6, 6' and the sock-like section 7. Furthermore, the support parts 6, 6' as well as the sock-like section 7 is surrounded by the tensioning element 8 which tensions the support parts 6, 6' as well as the sock-like section 7 at the foot of the wearer of the shoe.

Figure 2:
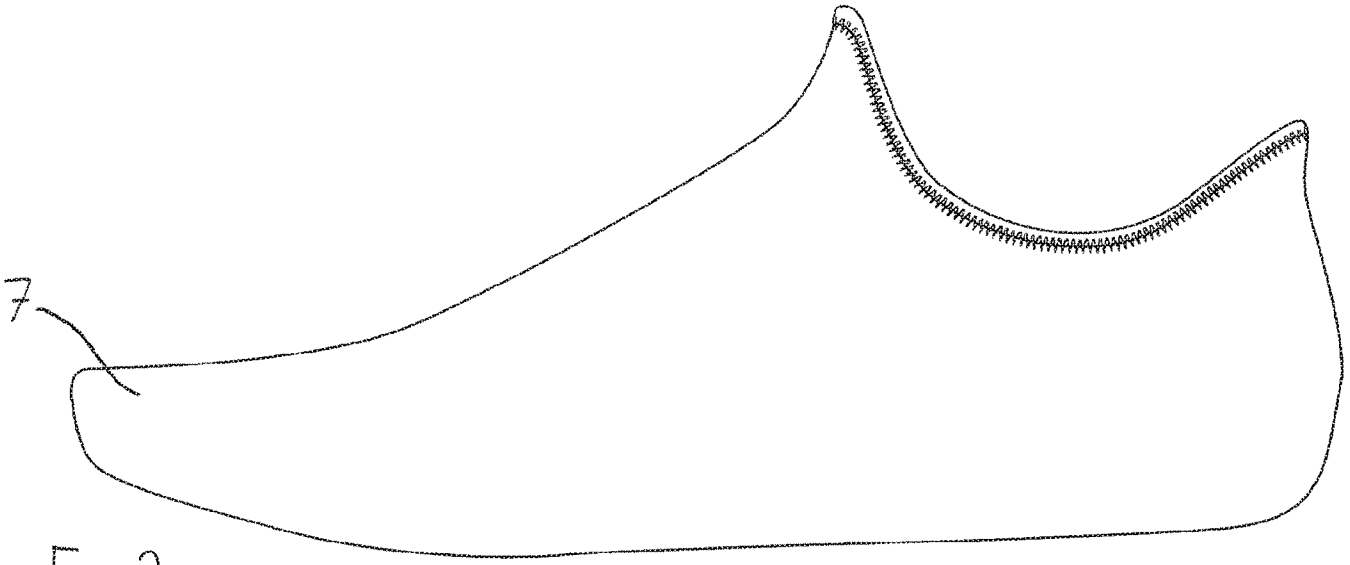
FIG. 2 shows the side view of a sock-like section which is a part of the shoe and especially of the shoe upper.

The design of the shoe can be seen again from the further figures:

In FIG. 2 the sock-like section 7 can be seen below which the sole part 4 is arranged according to FIG. 3. In FIG. 3 it can be seen again quite well how the support parts 6 and 6' extend upwards from the base region 5 of the sole part 4, wherein hereby it has to be understood that those parts extend substantially vertical upwards when the shoe stands on the ground.

Figure 3:
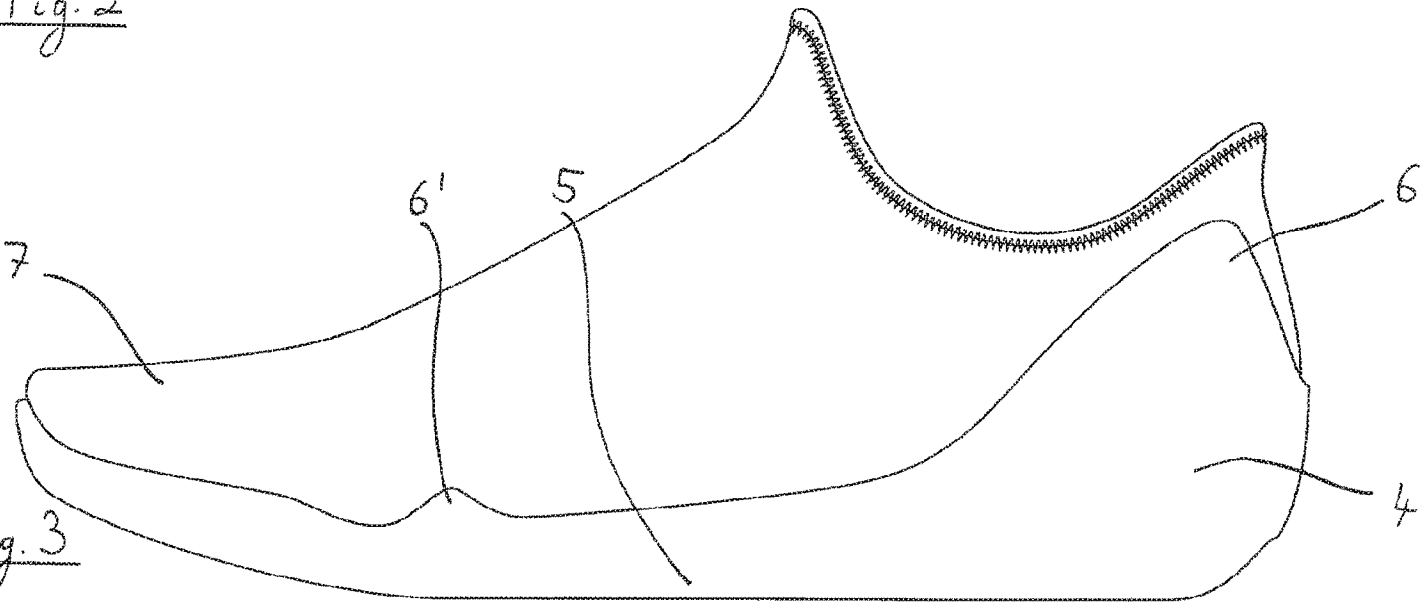
FIG. 3 shows the side view of the sock-like section which is now inserted into a sole part.
Figure 4:
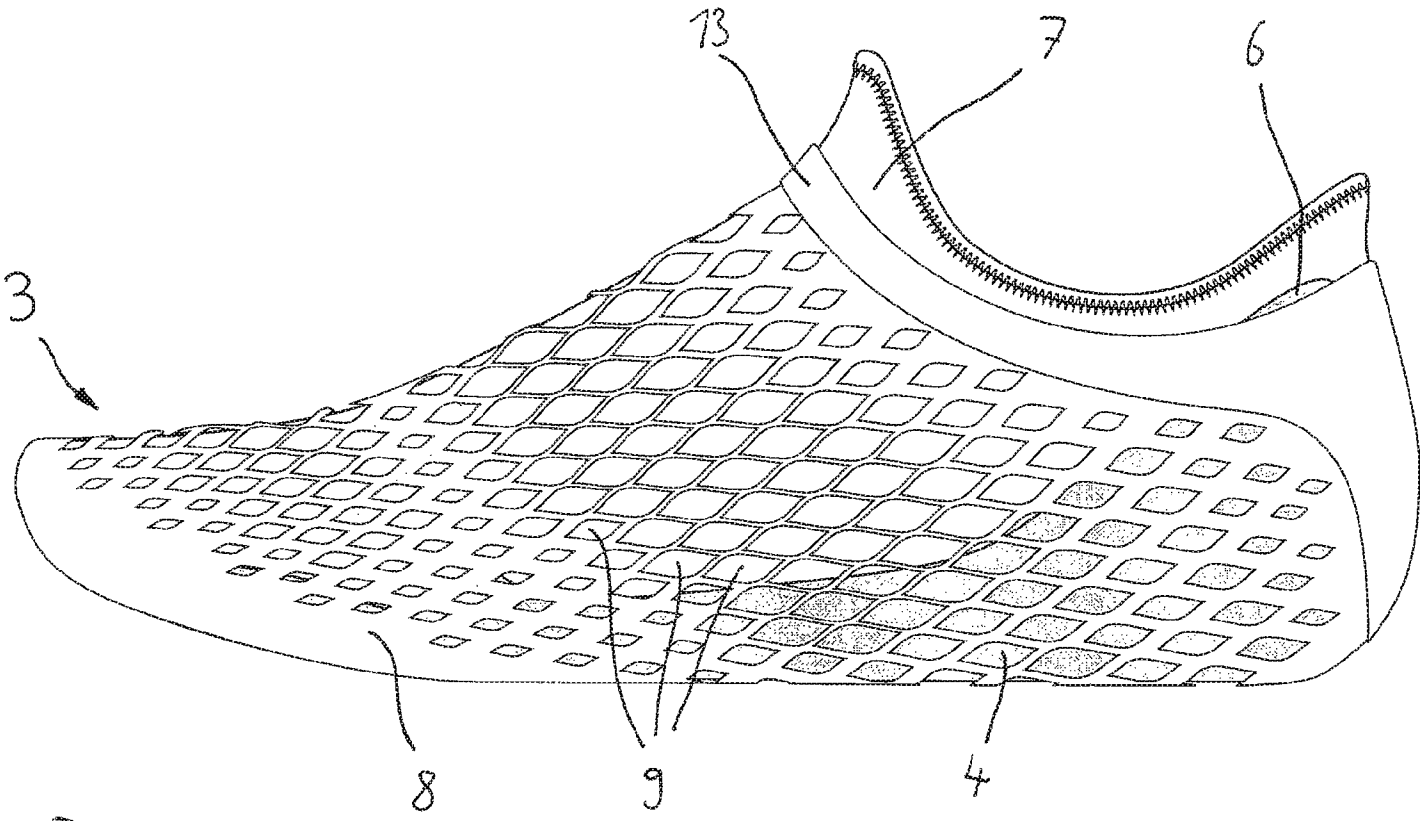
FIG. 4 shows the side view the sole part according to FIG. 3 including sock-like section and a tensioning element which is designed as net-like structure.

In FIG. 4 can be seen how the arrangement according to FIG. 3 is now surrounded by the tensioning element 8 from the outer side and can be tensioned when the shoe is laced at the foot of the wearer. In this figure it can also be seen that the tensioning element can be provided with a reinforcement rim 13 in the region of the entry of the foot into the shoe.

This reinforcement rim 13 can be designed as foil-like thin plastic element which also makes sure that the net-like structure of the tensioning element 8 is edged in this region and cannot easily frazzle.

Figure 5:
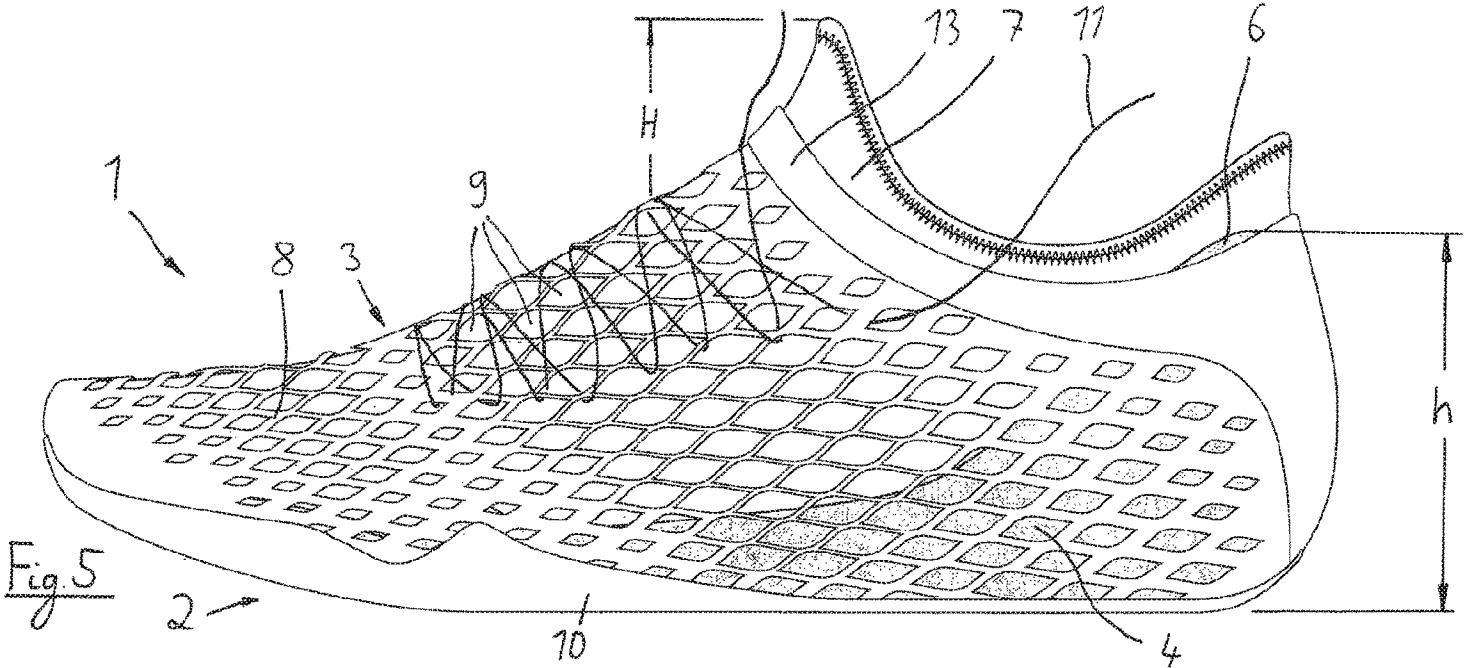
FIG. 5 shows the side view of the complete shoe.
Figure 6:
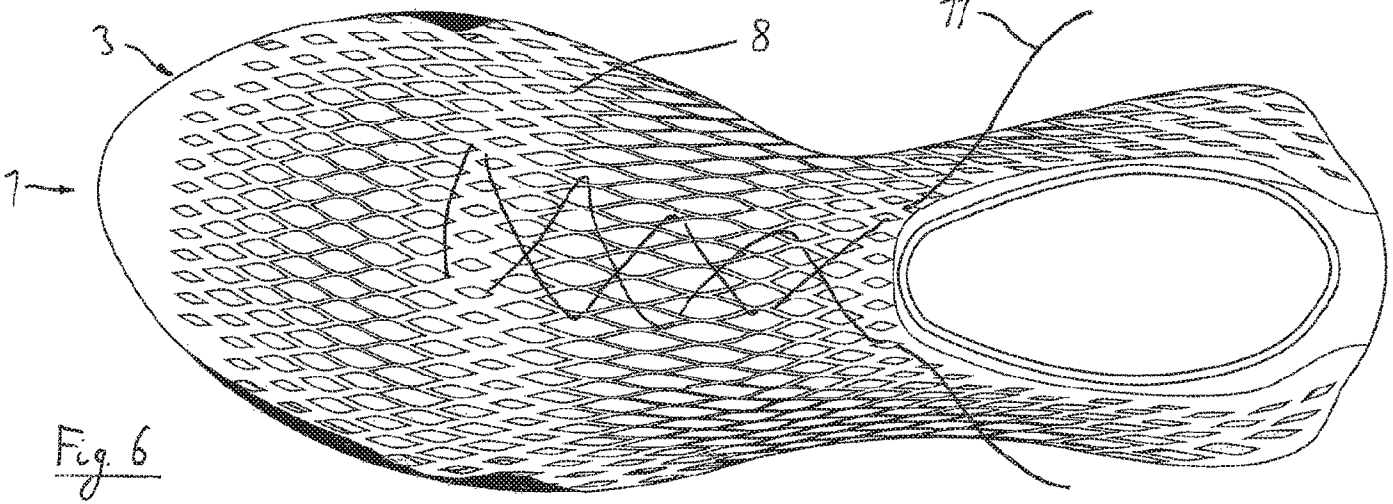
FIG. 6 shows the top plan view onto the complete shoe and FIG. 7 shows the view of the shoe from the rear side according to a similar embodiment of the invention, wherein the sole part which supports the heel as well as other components of the shoe are depicted.

The finished shoe is shown in FIG. 5 (in the side view) and FIG. 6 (in the top plan view). Here it can again be seen that the height h of the support part 6 in the rear side region of the shoe has a value which corresponds to at least 50% of the total height H of the shoe 1, preferably even significantly more.

Figure 7:
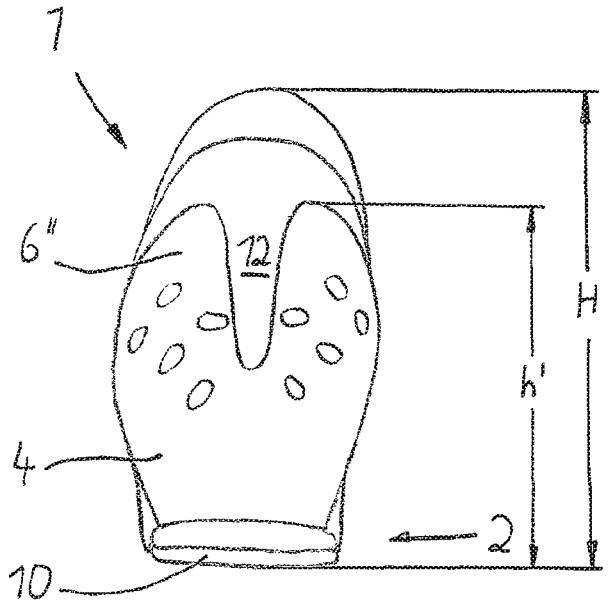

In FIG. 7 the shoe can be seen from the rear side—however not with all parts—namely in a bit different embodiment at which a support part 6" is provided in the heel region which—as described above—is formed at the sole part 4.

The support part 6" surrounds shell-like the heel of the foot of the wearer, but has however an insection 12 which is arranged in the center plane. Also here the height h' of the support part 6" is denoted, wherein with respect to this the same applies as described above with respect to the support part 6.

Thereby, a preferred embodiment of the invention provides that the support part 6 is arranged along the longitudinal axis of the shoe nearly in the midst of the shoe, while a support part 6" having an insection 12 is arranged in the heel region of the shoe.

LIST OF REFERENCES

1 Shoe
2 Sole
3 Shoe upper
4 Sole part
5 Base region
6 Support part
6' Support part
6" Support part
7 Sock-like section
8 Tensioning element (net-like structure)
9 Aperture
10 Outer sole
11 Lace
12 Insection
13 Reinforcement rim
H Total height of the shoe
h Height of the support part
h' Height of the support part

The invention claimed is:

1. A shoe, comprising a sole and a shoe upper, wherein the sole comprises an outer sole and a sole part which has a base region from which a support part extends upwards, wherein the shoe upper comprises a sock section connected to the sole for receiving a foot of a wearer, wherein the support part covers the sock section on an outer side of the shoe, wherein no firm connection exists between the support part and the sock section over at least a section of the support part and wherein both the support part and the sock section are surrounded by a tensioning element adapted to tension at least some sections of both the support part and the sock section against the foot of the wearer of the shoe, wherein the tensioning element is designed as a net structure which comprises a plurality of apertures, wherein a lace is threaded only into some apertures of the plurality of apertures of the tensioning element to tension the tensioning element at the foot of the wearer of the shoe, wherein the support part is arranged in a rear side region and/or in a heel region of the shoe, wherein the support part extends along a height of at least 40% of a total height of the shoe, wherein the tensioning element runs circumferentially around a bottom side of the shoe so that the tensioning element envelops a bottom region of the sock section and the base region of the sole part, wherein the tensioning element is fixed between the sole part of the sole and the outer sole which forms a bottom end of the shoe so that the tensioning element extends over a portion of a bottom of the sole part from a lateral side of the shoe to a medial side of the shoe.

2. The shoe according to claim 1, wherein the tensioning element is connected with the sole in a bottom region of the shoe.

3. The shoe according to claim 1, wherein an insole is arranged in an interior of the sock section.

4. The shoe according to claim 1, wherein a single support part is arranged in the heel region of the shoe, which comprises an insection in a central region.

5. The shoe according to claim 1, further including a support part arranged in a front or central region of the shoe.

6. The shoe according to claim 1, wherein the tensioning element, apart from a location in the heel region, is connected with the sole only in a bottom region of the sole and runs, apart from the connection with the sole in the bottom region, without connection around a region of the shoe upper.

7. The shoe according to claim 1, wherein the tensioning element comprises a circumferential reinforcement rim in a region of foot entry, wherein the circumferential reinforcement rim is formed by a flat plastic band.

* * * * *